US008205363B2

(12) United States Patent
Lin et al.

(10) Patent No.: US 8,205,363 B2
(45) Date of Patent: Jun. 26, 2012

(54) STEAM IRONING MACHINE

(75) Inventors: Loyi Lin, Tainan County (TW); Tingjui Lin, Tainan (TW)

(73) Assignee: Tsann Kuen (China) Enterprise Co., Ltd., Xiamen (CN)

( * ) Notice: Subject to any disclaimer, the term of this patent is extended or adjusted under 35 U.S.C. 154(b) by 340 days.

(21) Appl. No.: 12/527,259

(22) PCT Filed: Feb. 13, 2008

(86) PCT No.: PCT/CN2008/000332

§ 371 (c)(1),
(2), (4) Date: Nov. 17, 2009

(87) PCT Pub. No.: WO2008/098487

PCT Pub. Date: Aug. 21, 2008

(65) Prior Publication Data

US 2010/0058625 A1 Mar. 11, 2010

(30) Foreign Application Priority Data

Feb. 14, 2007 (CN) ..... 2007 2 0006409 U

(51) Int. Cl.
*D06F 75/40* (2006.01)
*D06F 75/12* (2006.01)

(52) U.S. Cl. ..... 38/77.6; 38/96

(58) Field of Classification Search ..... 38/77.6, 38/96, 107, 142, 75, 69, 79; 219/259
See application file for complete search history.

(56) References Cited

U.S. PATENT DOCUMENTS

| | | | | | |
|---|---|---|---|---|---|
| 699,922 | A * | 5/1902 | Hyson et al. | 38/104 |
| 2,485,299 | A * | 10/1949 | Levey | 219/259 |
| 2,860,427 | A * | 11/1958 | Fastinger | 38/142 |
| 4,574,503 | A * | 3/1986 | Bertani | 38/77.6 |
| 5,315,773 | A * | 5/1994 | Iwami et al. | 38/77.6 |
| 6,711,840 | B1 * | 3/2004 | Rosenzweig | 38/69 |
| 7,210,254 | B2 * | 5/2007 | Docker | 38/104 |

FOREIGN PATENT DOCUMENTS

| | | |
|---|---|---|
| CN | 2188108 | 1/1995 |
| CN | 2322995 | 6/1999 |
| CN | 2454400 | 10/2001 |
| CN | 2476580 | 2/2002 |
| CN | 1715548 A | 1/2006 |
| CN | 1715549 A | 1/2006 |
| CN | 1936165 A | 3/2007 |
| WO | WO-01/53596 A1 | 7/2001 |
| WO | WO-2006/027464 A1 | 3/2006 |

* cited by examiner

*Primary Examiner* — Ismael Izaguirre
(74) *Attorney, Agent, or Firm* — Rabin & Berdo, P.C.

(57) ABSTRACT

A steam ironing machine, at least comprises a base, a telescopic shaft and an ironing device, wherein the base is provided with a steam generator and an outer case surrounding it. The telescopic shaft with a support seat mounted on its top end is disposed on the base and the support seat can move a distance relative to the base. The ironing device can detachedly be mounted on the support seat, wherein the steam generator in the base is attached to the ironing device.

13 Claims, 7 Drawing Sheets

STEAM IRONING MACHINE

FIELD OF THE INVENTION

The present invention generally relates to a steam ironing machine, particularly, to a steam ironing machine with a vertically adjustable support seat supporting an iron.

BACKGROUND OF THE INVENTION

Referring to FIG.1, which shows the stereogram of a known steam ironing machine. The steam ironing machine 100 comprises a base 110 and an iron 120. Plural insulating salient points 140 are provided on the base 110. The iron 120 is positioned on the salient points 140. A boiler 112 used to generate steam is provided in the base 110. The steam in the boiler 112 goes through a tube 130 to the iron 120. Steam can be ejected from the iron 120 to achieve a preferred ironing purpose.

However, some disadvantages exist in this steam ironing machine 100, for example, the base 110 can not be moveable at random in the ironing process, there is an altitude difference between the base 110 and the iron 120 in the ironing process, and it is inconvenient for a user to pick or place the iron 120 up/on the salient points 140 of the base 110. So the known steam ironing machine 100 can not satisfy the user's actual demand nowadays.

SUMMARY OF THE INVENTION

Thereby an improved steam ironing machine is required for resolving the problem inconvenient for user to take or put the iron away/on the base of the steam ironing machine, and satisfies user's actual demand nowadays.

One objective of the present invention is to provide a is steam ironing machine, a telescopic shaft is fixed on the base, and a support seat connected with said telescopic shaft, an ironing device is positioned on the support seat, the altitude difference between the base and the ironing device can be adjustable, so the user can conveniently pick or place the ironing device up/on the support seat even though there is an altitude difference between the base and the ironing position of the ironing device in the ironing process, thus the use of inconvenience in the common steam ironing machine that has been resolved.

The other objective of the present invention is to provide a steam ironing machine, designed by a support seat with an adjustable inclination angle to achieve the convenience of picking or placing the ironing device in the using process and the space saving in storing, thus resolve the problem that common steam ironing machine can not satisfy user's actual demand.

One preferred embodiment based on the present invention, a steam ironing machine comprises at least a base, a telescopic shaft and an ironing device, wherein said base is provided with a steam generator and an outer case surrounding said steam generator. The telescopic shaft is fixed on the base, a support seat is set on the top of telescopic shaft, said support seat can move a distance relative to base. The ironing device is detachedly mounted on the support seat, the steam generator of the base is connected with the ironing device.

The other preferred embodiment based on the present invention, a steam ironing machine comprises at least a base, a support seat and an ironing device, wherein said base is provided with a steam generator and an outer case surrounding said steam generator. The support seat is fixed on base, wherein the angle between the supporting face of the support seat and the horizontal plane is 0°~90°, a buckling portion is positioned on the support seat. The ironing device is detachedly mounted on the support seat, the ironing device is fastened by said buckling portion of the support seat, the steam generator of the base is connected with the ironing device.

One preferred embodiment based on the present invention, said ironing device is an iron.

One preferred embodiment based on the present invention, said steam generator is a boiler.

The steam ironing machine applying above invention, since a telescopic shaft is fixed on the base of the steam ironing machine, and a support seat connected with said telescopic shaft, so an altitude difference between the base and the ironing device positioned on the support seat can be adjusted, therefore it is convenient for user to pick or place the ironing device up/on the support seat even though there is an altitude difference between the base and the ironing device in the ironing process.

So the present invention compared with other steam ironing machines, adjusting the altitude difference between the base and the ironing device to ensure the distance between ironing position and the support seat is shortest and achieve the convenience of picking or placing the ironing device in the using process. In addition, the support seat supporting the ironing device can be adjusted at different inclination angles, to achieve the convenience of picking or placing the ironing device in the using process and the space saving in storing, satisfying user's actual demand.

BRIEF DESCRIPTION OF THE DRAWINGS

For clearly understanding the objective, characters and the advantages of the present invention, the preferred embodiment of the invention will become apparent from the following detailed description with appropriate reference to the accompanying drawings.

The description of the numbers of the primary members

| | |
|---|---|
| 100: a steam ironing machine | 110: a base |
| 112: a boiler | 120: an iron |
| 130: a tube | 140: an insulating salient point |
| 200: a steam ironing machine | 210: a base |
| 210a: wheels | 212: a steam generator |
| 214: an outer case | 214a: an upper surface |

-continued

| | |
|---|---|
| 216: an upper cover | 218: a space |
| 220: a telescopic shaft | 220a: a top end |
| 230: an ironing device | 232: a tube |
| 240: a support seat | 242: a buckling portion |
| 244: an insulating salient point | 250: a handle |
| 260: an altitude difference | 270: the first position |
| 272: the second position | |
| 300: a steam ironing machine | 310: a base |
| 312: a steam generator | |
| 314: an outer case | 320: a support seat |
| 320a: a supporting face | |
| 320b: a buckling portion | 330: an ironing device |
| 340: a tube | |
| 350: the horizontal plane | |

DETAILED DESCRIPTION OF THE PREFERRED EMBODIMENT

Figure 1:
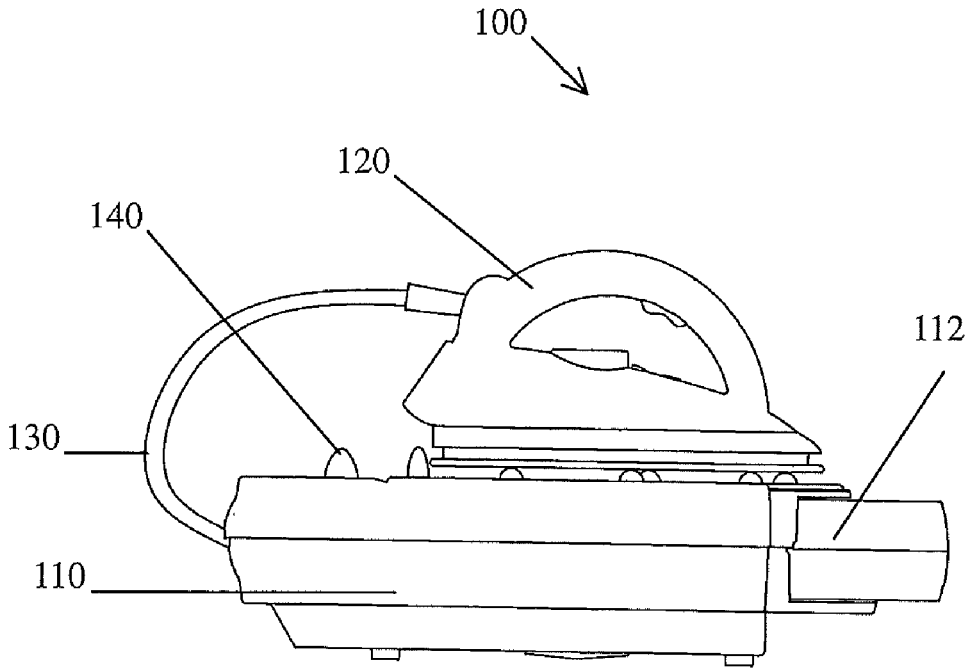
FIG.1 Prior Art
FIG. 1 is a perspective view of the known steam ironing machine.
Figure 2A:
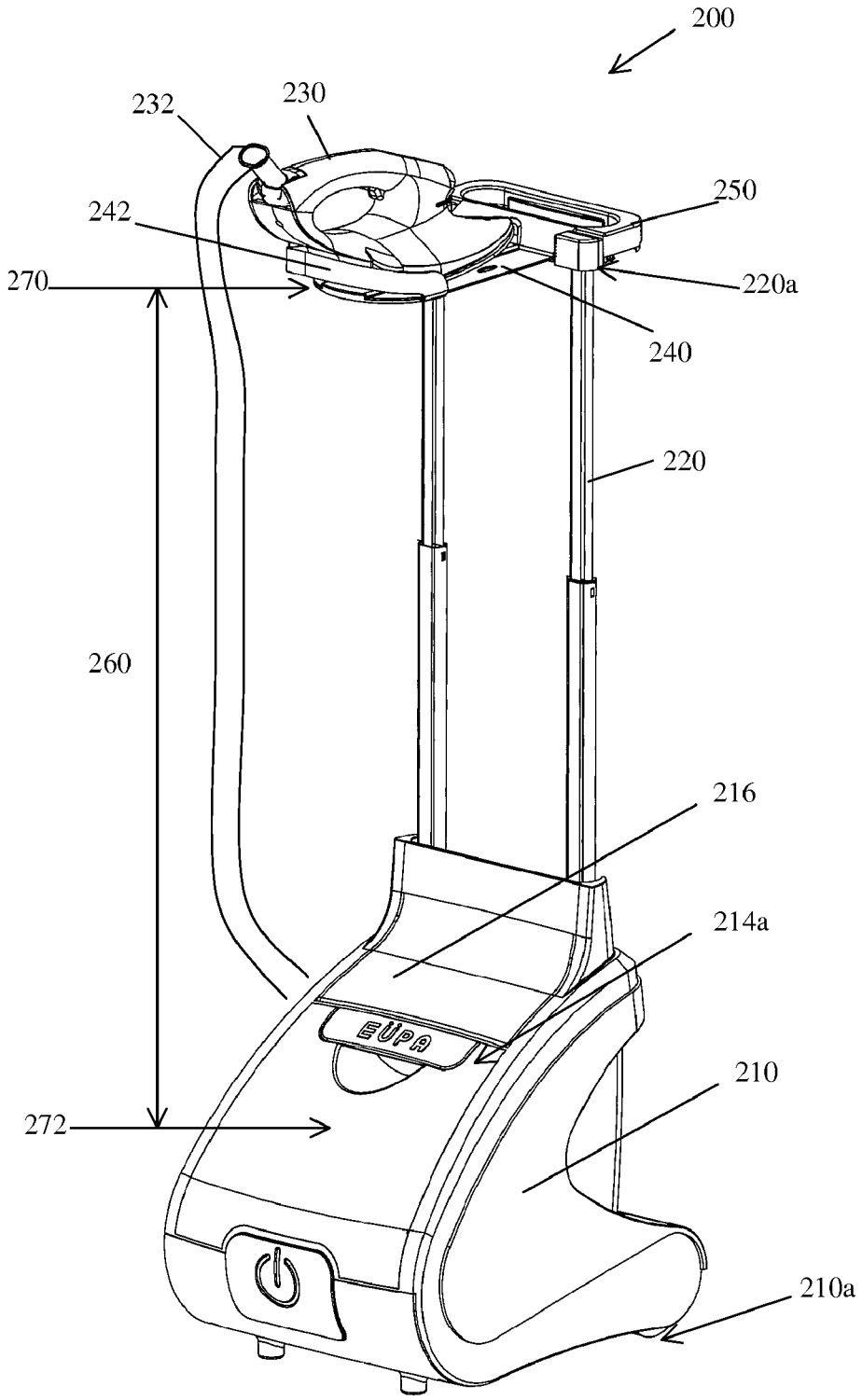
FIG. 2A is a perspective view of the steam ironing machine 200 of one preferred embodiment of the present invention in using state.
Figure 2B:
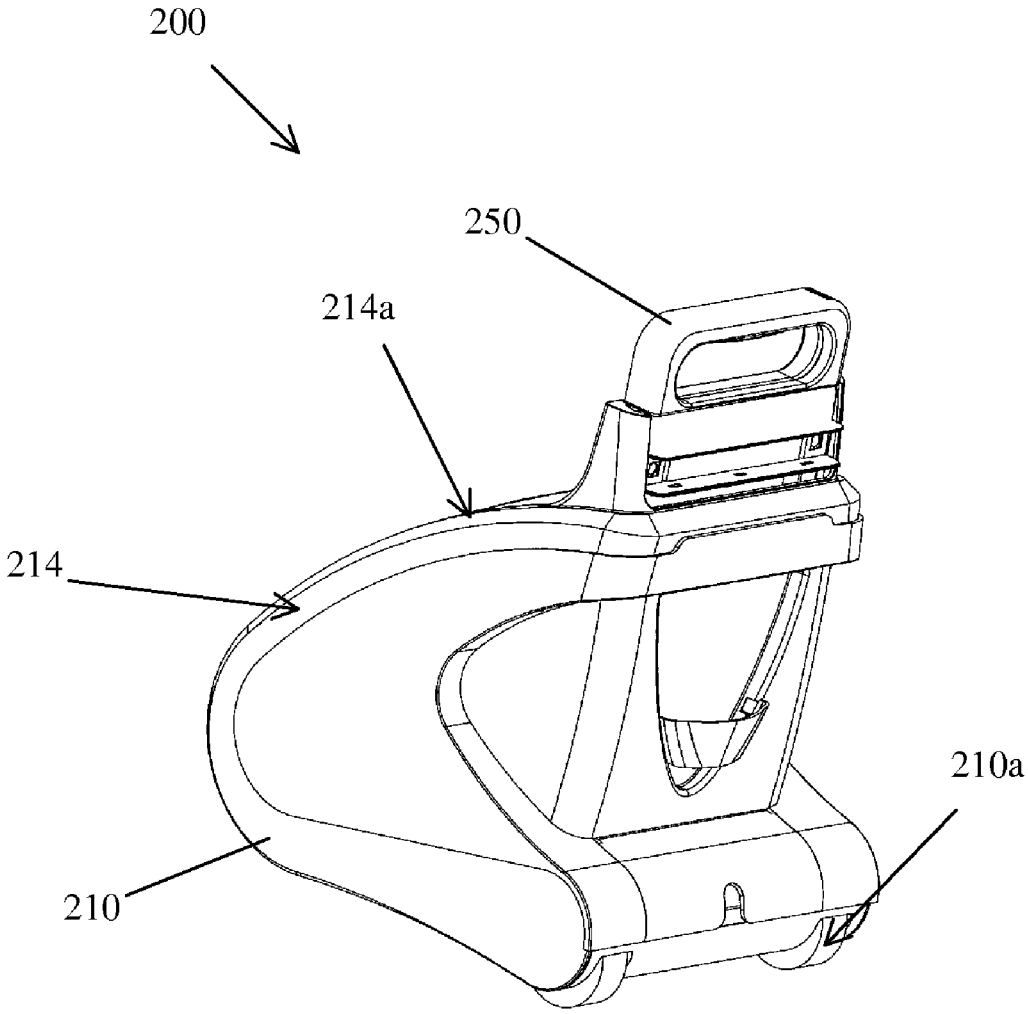
FIG. 2B is a perspective view of the steam ironing machine 200 of one preferred embodiment of the present invention in storage state.
Figure 2C:
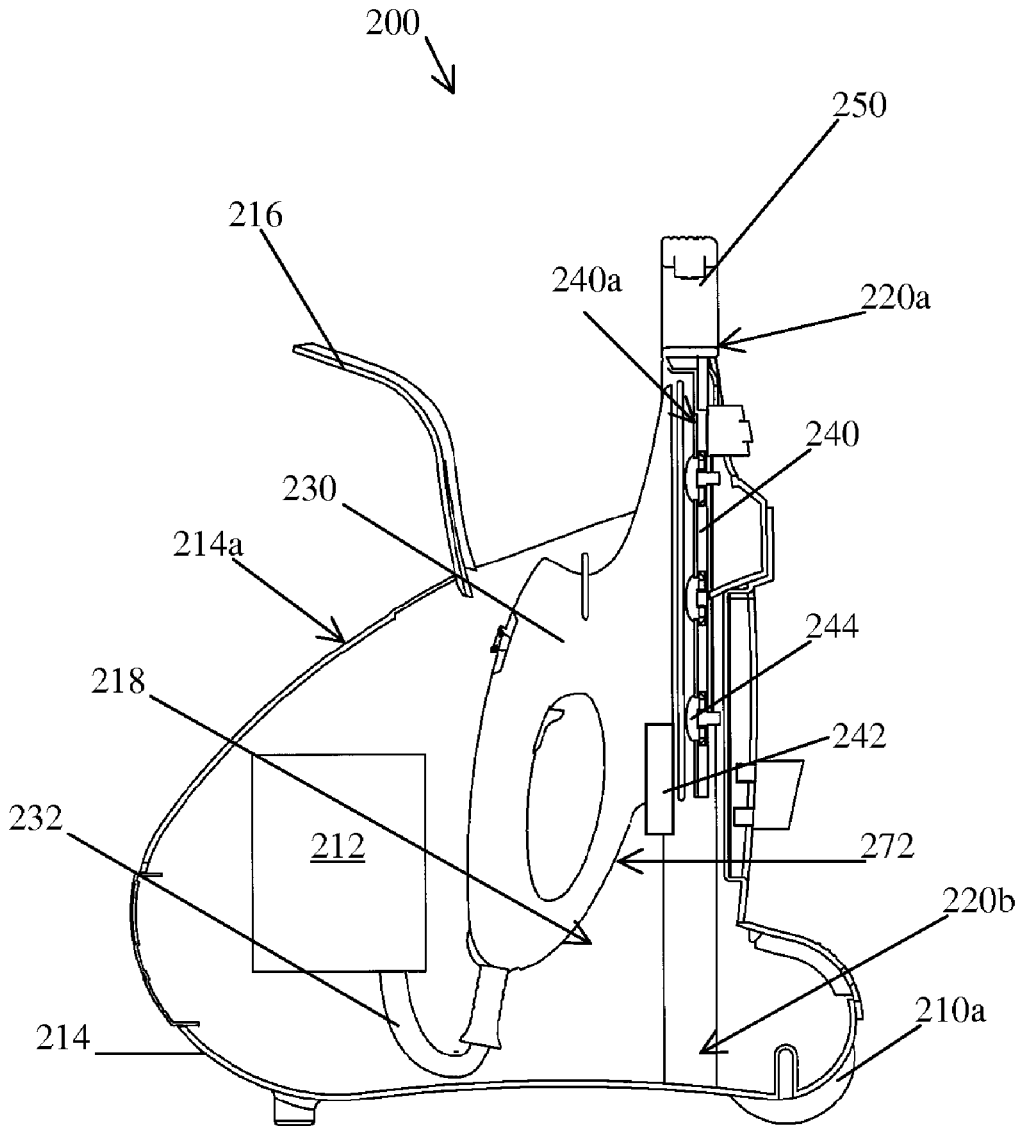
FIG. 2C is a sectional view of the steam ironing machine 200 of one preferred embodiment of the present invention in storage state.
Figure 2D:
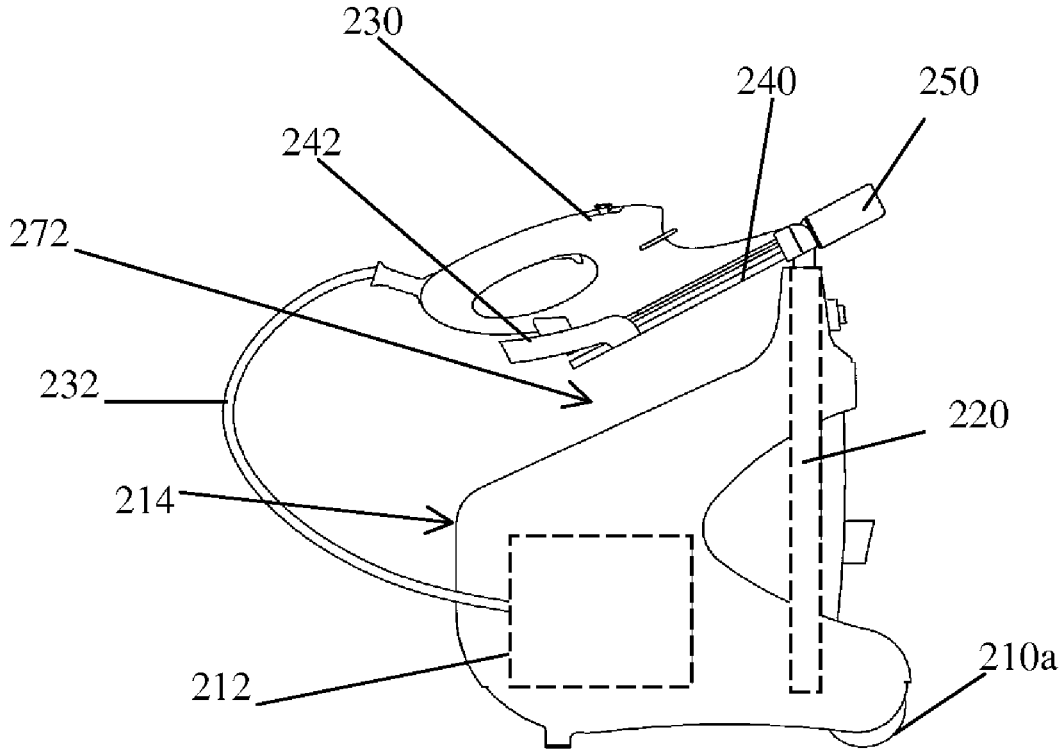
FIG. 2D is a sectional view of the steam ironing machine 200 of another preferred embodiment of the present invention in storage state.

Referring to FIG.2A and FIG. 2B, FIG.2C, respectively illustrating a perspective view of the steam ironing machine 200 of one preferred embodiment of the present invention in a using state; a perspective view of the steam ironing machine 200 of one preferred embodiment of the present invention in a storage state; and a sectional view of the steam ironing machine 200 of one preferred embodiment of the present invention in the storage state. The steam ironing machine comprises a base 210, a telescopic shaft 220, an ironing device 230, wherein the base 210 has a steam generator 212 (for example a boiler), and an outer case 214 surrounding said steam generator 212. The telescopic shaft 220 is fixed on base 210. A support seat 240 is set on the top end 220*a* of the telescopic shaft 220. The support seat 240 can be rotatablely fixed on the telescopic shaft 220, and can move an altitude difference 260 with the telescopic shaft 220 relative to the base 210. In the present embodiment, this altitude difference 260 is about 70 cm~110 cm. The ironing device 230 is detachedly mounted on the support seat 240. The steam generator 212 of the base 210 is connected with the ironing device 230 by the tube 232. In this embodiment, the ironing device 230 is an iron, but it is not limited by an iron, a steam sprayer is applicable. A handle 250 is connected with the support seat 240. This handle 250 is convenient for the user to move the base 210. In this embodiment, a movable upper cover 216 is set on the upper surface 214*a* of the outer case 214. A space 218 in the outer case 214 contains the ironing device 230. A buckling portion 242 is positioned on the support seat 240. This buckling portion 242 is used for fastening the ironing device 230, for preventing the ironing device 230 from falling off the support seat 240. The support seat 240 can be rotated about 90° relative to the top end 220*a* of the telescopic shaft 220, i.e. the angle of rotation of the support seat 240 is about 0°~90°, thereby adjusting the angle of Inclination of the supporting face 240*a* of the support seat 240. In this embodiment, at least two wheels 210*a* are provided on the base 210 to make it convenient for the user to move the base 210. In addition, insulating salient points 244 are provided on the support seat 240, thereby preventing the heat of the ironing device 230 from transferring to the support seat 240. In this embodiment, the telescopic shaft 220 has two rods, for fixing the support seat 240 and handle 250, and also to make it convenient for the user to push/pull. It can be understood that the support seat 240 can move between the first position 270 and the second position 272, wherein the first position 270 is far away from the base 210, and the second position 272 is in the space 218 of the base 210 containing the ironing device 230. Alternatively, when the space 218 containing the ironing device 230 is not provided in the base 210, the second position 272 is above the base 210, referring to FIG. 2D.

Figure 3A:
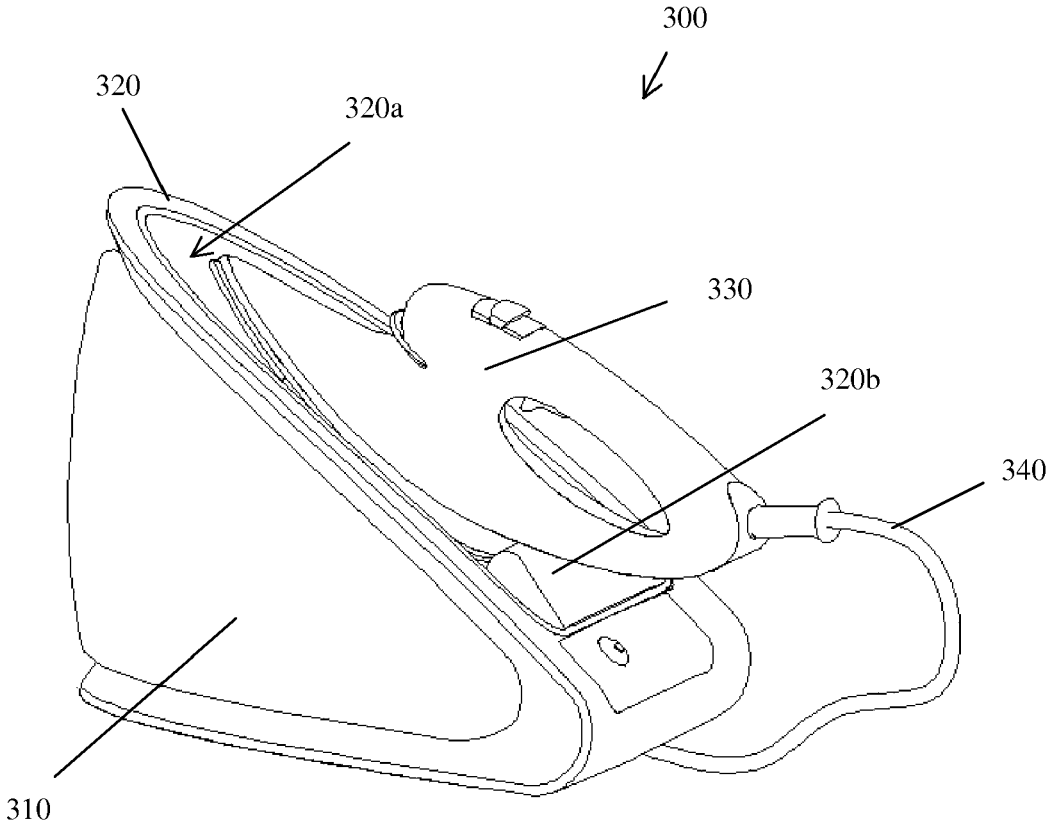
FIG. 3A is a perspective view of the steam ironing machine of another preferred embodiment of the present invention in using state.
Figure 3B:
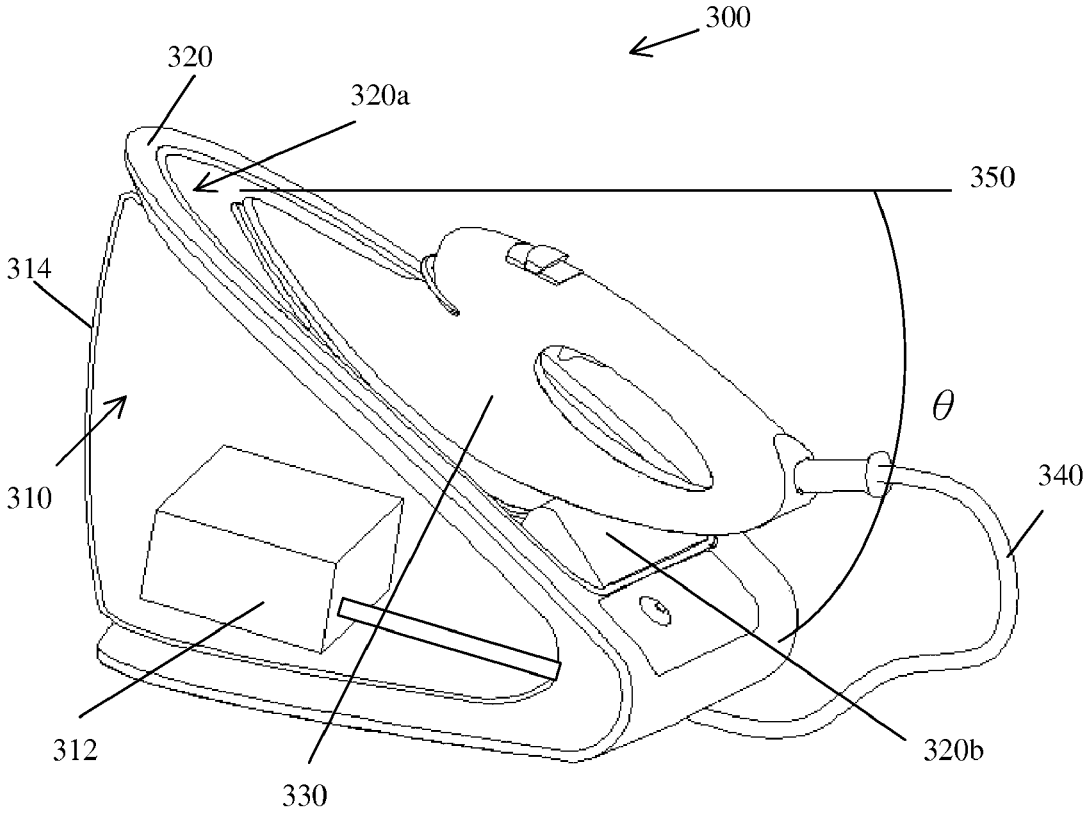
FIG. 3B is a sectional view of the steam ironing machine of another preferred embodiment of the present invention in using state.

Referring to FIG.3A and FIG. 3B, respectively illustrating a perspective view and a sectional view of the steam ironing machine 300 of another preferred embodiment of the present invention in using state. The steam ironing machine300 comprises a base 310, a support seat 320, and an ironing device 330, wherein the base 310 has a steam generator 312, and an outer case 314 surrounding said steam generator 312. The support seat 320 is fixed on base 310, wherein the angle θ between the supporting face 320*a* of the support seat 320 and the horizontal plane 350 is 0°~90°. A buckling portion 320*b* is positioned on the support seat 220. The buckling portion 320*b* is used for fastening the ironing device 330, for preventing the ironing device 330 from falling off the support seat 320. The ironing device 330 is detachedly mounted on the support seat 320. The ironing device 330 is fastened by said buckling portion 320*b* of the support seat 320. The steam generator 312 of the base 310 is connected with the ironing device 330 by the tube 340. In this embodiment, the support seat 220 is fixed on the base 310. The inclination angle of the supporting face 320*a* is fixed, but it is not limited, the support seat 220 can rotate 90° relative to the base 310, adjusting the supporting face 320*a* according to the user's requirement. In addition, the ironing device 330 is an iron, but it is not limited by an iron, a steam sprayer is applicable. Alternatively, for the support seat 320 moves a distance relative to the base 310, compared with the above embodiments(illustrating in FIG. 2A,2B), a telescopic shaft is connected with the support seat 320, wherein the top end of the telescopic shaft is connected with the support seat 320, the bottom end of the telescopic shaft is connected with the base 310, when the top end of the telescopic shaft moves upwardly, the support seat 320 can move upwardly relative to the base 310 too, in addition, a handle is connected with the support seat 320.

Industrial Applicability

As mention above, the seam ironing machine of the present invention, the construction features: a telescopic shaft is mounted on the base of the steam ironing machine, and a support seat is connected with the telescopic shaft, when the ironing device is positioned on the support seat, the altitude difference between the ironing device and the base is changed by adjusting the altitude difference between the telescopic shaft and the support seat, when the altitude difference between the ironing device and the base exists in the ironing process, the user can conveniently pick or place the ironing device up/on the support seat. Comparing the steam ironing machine based on the present invention with the known steam ironing machine, the construction features of the present invention ensure the distance between ironing position and the support seat is shortest and achieve the convenience of picking or placing the ironing device in the using process.

As the mention of the above embodiments based on the present invention, the advantages of the steam ironing machine based on the present invention, a telescopic shaft is mounted on the base of the steam ironing machine, and a support seat is connected with the telescopic shaft, the picking or placing position of the ironing device can be adjusted freely, this can satisfy user's actual demand. In addition, the support seat can be adjusted at different inclination angles, to achieve the convenience of picking or placing the ironing device in the using process and the space saving in storing.

The described embodiments are to be considered in all respects only as illustrative and no restrictive. All changes which come within the meaning and range of equivalency of the claims are to be embraced with their scope.

The invention claimed is:

1. A steam ironing machine, comprising:

a base provided with a steam generator and an outer case surrounding the steam generator;

a telescopic shaft mounted on the base;

a support seat set on a top of the telescopic shaft, the support seat being movable a distance relative to base, a buckling portion being positioned on the support seat; and an ironing device detachedly mounted on the support seat, the steam generator being connected with the ironing device, the buckling portion being used for fastening the ironing device.

2. The steam ironing machine according to claim 1, wherein the ironing device is an iron.

3. The steam ironing machine according to claim 2, wherein a handle is connected with the support seat.

4. The steam ironing machine according to claim 3, wherein the support seat is movable between a first position and a second position relative to the base, wherein the first position is far away from the base, and the second position is above the base.

5. A steam ironing, comprising:

a base provided with a steam generator and an outer case surrounding the steam generator;

a telescopic shaft mounted on the base;

a support seat set on a top of said telescopic shaft, the support seat being movable a distance relative to base;

a handle connected with the support seat; and an iron detachedly mounted on the support seat, the steam generator being connected with the iron;

wherein a movable upper cover is set on an upper surface of the outer case, and wherein a space in the outer case contains the iron.

6. The steam ironing machine according to claim 5, wherein the support seat is movable between a first position and a second position relative to the base, wherein the first position is far away from the base, and the second position is in the space.

7. The steam ironing machine according to claim 1, wherein the support seat is rotatable about 90° relative to the top end of the telescopic shaft.

8. The steam ironing machine according to claim 7, wherein at least two wheels are provided on the base.

9. The steam ironing machine according to claim 1, wherein the telescopic shaft has two rods.

10. A steam ironing machine, comprising:

a base provided with a steam generator and an outer case surrounding the steam generator;

a support seat fixed on the base, an angle between a supporting face of the support seat and a horizontal plane being 0°~90°, a buckling portion being positioned on the support seat;

an iron detachedly mounted on the support seat, the iron being fastened by the buckling portion, the steam generator being connected with the iron;

a telescopic shaft having a top thereof connected with the support seat, a bottom of the telescopic shaft being connected with the base, the support seat being movable a distance relative to the base; and a handle connected with the support seat;

wherein the support seat is movable between a first position and a second position relative to said base, wherein the first position is far away from the base, and the second position is above the base; and wherein a movable upper cover is set on an upper surface of the outer case, a space in the outer case containing said iron.

11. The steam ironing machine according to claim 10, wherein the support seat is rotatable about 90° relative to the base.

12. The steam ironing machine according to claim 11, wherein at least two wheels are provided on the base.

13. The steam ironing machine according to claim 12, wherein the telescopic shaft has two rods.

* * * * *